US007098412B1

(12) United States Patent
Sikora

(10) Patent No.: US 7,098,412 B1
(45) Date of Patent: Aug. 29, 2006

(54) PRESSURE ACTIVATED LATCHING SWITCH

(75) Inventor: Robert M. Sikora, San Jose, CA (US)

(73) Assignee: Cymscape Incorporated, San Jose, CA (US)

( * ) Notice: Subject to any disclaimer, the term of this patent is extended or adjusted under 35 U.S.C. 154(b) by 17 days.

(21) Appl. No.: 11/069,432

(22) Filed: Mar. 1, 2005

(51) Int. Cl.
*H01H 35/34* (2006.01)

(52) U.S. Cl. ..... 200/81 R; 200/83 R

(58) Field of Classification Search ..... 200/81 R, 200/82 R, 82 C, 82 E, 83 B, 83 F, 83 J, 200/83 L, 83 P; 73/861.42, 861.44, 861.47, 73/715

See application file for complete search history.

(56) References Cited

U.S. PATENT DOCUMENTS

| | | | | |
|---|---|---|---|---|
| 3,824,512 | A * | 7/1974 | Glass | 335/205 |
| 4,126,049 | A * | 11/1978 | Cotter | 73/702 |
| 4,237,354 | A * | 12/1980 | Rockenfeller et al. | 200/83 C |
| 4,762,969 | A * | 8/1988 | Tracey | 200/81.4 |
| H1292 | H * | 3/1994 | Marsh | 60/326 |
| 5,793,131 | A * | 8/1998 | Fisher et al. | 310/68 A |
| 6,186,176 | B1 | 2/2001 | Gelbmann | |

* cited by examiner

*Primary Examiner*—Michael A. Friedhofer
(74) *Attorney, Agent, or Firm*—John P. McMahon

(57) ABSTRACT

A structure embodying a switch and method of operating thereof for creating a latching switch is disclosed. The latching switch utilizes an electrorheologic fluid and the electronic latch function thereof is actuated by a pressure signal and deactivated by the removal of both the pressure signal and a holding voltage.

11 Claims, 3 Drawing Sheets

PRESSURE ACTIVATED LATCHING SWITCH

CROSS REFERENCE TO RELATED APPLICATION

This application is related to U.S. patent application Ser. No. 11/069,680 and filed herewith.

FIELD OF THE INVENTION

This invention relates to a switch and a method of operation thereof, and, more particularly, to a switch and a method of operating thereof that provide electronic latching of the switch and that utilizes an electrorheologic fluid, wherein the electronic latching is actuated by a pressure signal and deactivated by the removal of both a pressure signal and a latching voltage.

BACKGROUND OF THE INVENTION

The electronic and electromagnetic latching relays are well-known and fine wide applications in the field of controlling electrical signals. These electronic and electromagnetic latching relays find limited use in the field of controlling the flow of fluids. More particularly, the flow of fluid is typically controlled by a pressure signal applied to a fluid control valve that responds thereto by either being activated or deactivated. It is desired that a switch be provided for that is used in conjunction with the control of the pressure signal so as to control the flow of fluid and which switch provides a latching function that locks into whatever mode is energized for on or off condition of the related fluid control switch.

OBJECTS OF THE INVENTION

Accordingly, it is an object of the present invention to provide a switch and a method of operation thereof that provides a latching function for the flow of liquid controlled by a pressurized signal.

It is a further desire of the present invention to provide a switch and a method of operation thereof that is activated by a pressure signal and deactivated by both the pressure signal and a latching voltage.

It is another object of the present invention to provide a switch, and a method of operation thereof, that provides control over the flow of fluid even in the unattended loss of a pressure signal that initiated the activation of the switch itself.

SUMMARY OF THE INVENTION

The present invention is directed to a switch, and a method of operation thereof, that is activated by a pressure signal and deactivated by the removal of both the pressure signal and a holding voltage.

The latching switch comprises a chamber containing an electrorheologic fluid. The chamber has first, second, third and fourth terminals and has an opening serving as an input portion capable of receiving a pressurized fluid. The latching relay further comprises at least a pair of spaced apart electrodes located within the chamber and with one of the electrodes connected to the first terminal. The latching relay further comprises at least a pair of switches each having first and second fixed contacts and each contact thereof being operatively interconnectable therebetween by a movable contact. Each of the switches being responsive to the received pressure so as to be rendered operable. One of the pair of switches has its first and second fixed contacts respectively connected to the second and third terminals. Further, the other of the pair of switches has its first contact connected to the fourth terminal and its second contact connected to the other electrode. The latching switch further has first and second diaphragms respectively and completely covering each of the pair of switches. Each of the first and second diaphragms being flexibly responsive to the pressurized fluid.

The method of latching a switch comprises the steps of: a) providing a chamber containing an electrorheologic fluid and having first, second, third and fourth terminals and having an opening capable of receiving a pressurized fluid; b) providing at least a pair of spaced apart electrodes being located with the chamber. The method further comprises: c) connecting one of said electrodes to the first terminal; and d) providing at least a pair of switches each having first and second fixed contacts operatively interconnectable therebetween by a movable contact, each switch thereof being located within the chamber and being responsive to the received pressurized fluid. The method further comprises the steps of: e) connecting the first and second fixed contacts of one of the pair of switches to the second and third terminals respectively; f) connecting the other of the pair of switches so that its first contact is connected to the fourth terminal and its second contact is connected to the other electrode of the pair of spaced apart electrodes; g) providing first and second diaphragms respectively and completely covering each of the pair switches, each of the first and second diaphragms being flexibly responsive to the pressurized fluid; h) connecting the first, second, third and fourth terminals respectively to a ground potential, an input signal, an output signal, and a latching voltage; and finally, i) applying the pressurized fluid.

DETAILED DESCRIPTION OF THE PREFERRED EMBODIMENTS

Figure 1:
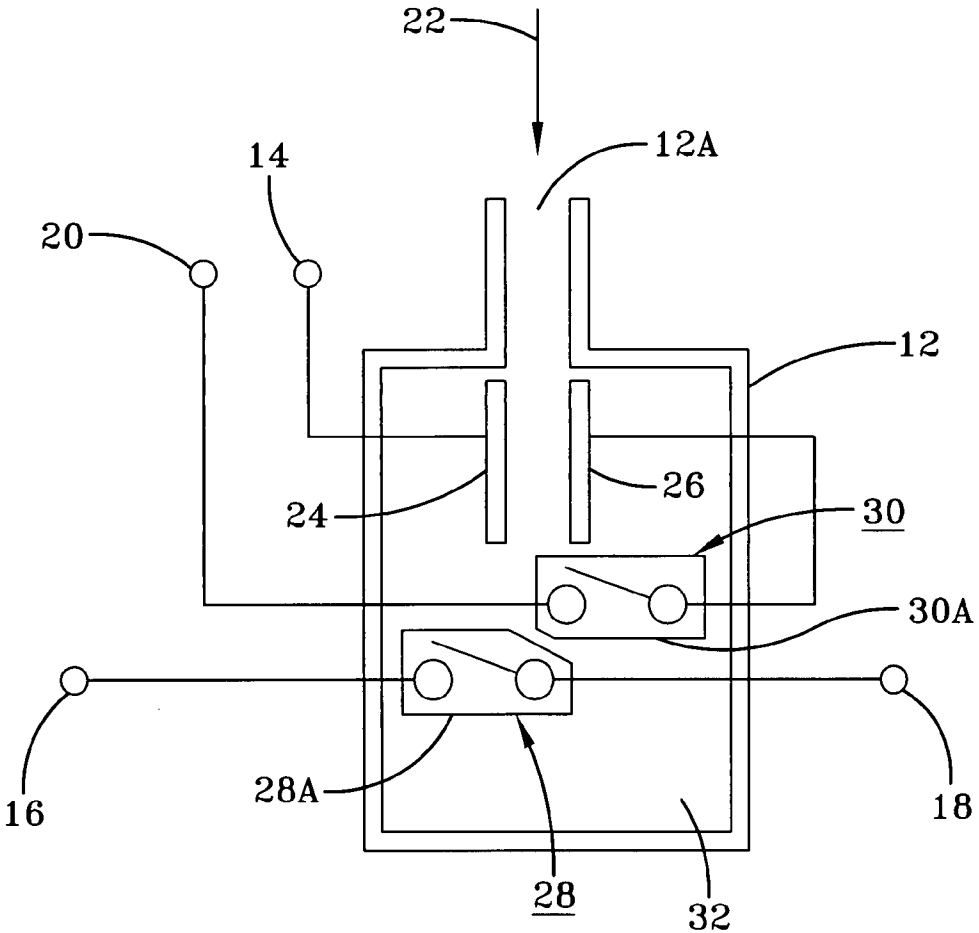
FIG. 1 is a schematic of the latching switch according to the present invention.

With reference to the drawings, wherein the same reference number indicates the same element throughout, FIG. 1 is a schematic of a latching switch 10 in accordance with the present invention which, as will be described hereinafter, is activated by a pressure signal and deactivated by the removal of both the pressure signal and a latching voltage.

The latching switch 10 comprises a chamber 12 having first, second, third and fourth terminals respectively identified by reference number 14, 16, 18, and 20. The chamber 12 has an opening 12A, which serves an input port for receiving pressurized fluid, shown by directional arrow 22, and which serves as a pressure signal for operating switch 10.

A pair of spaced apart electrodes 24 and 26 are located within the chamber 12 and one of the electrodes, such as 24, is connected to the first terminal 14.

The latching switch 10 further comprises at least a pair of switches 28 and 30 located within the chamber 12 and responsive, as will be further described to the received pressure fluid 22. As seen in FIG. 1, each of the switches have first and second fixed contacts that are operatively interconnected therebetween by a movable contact. One of the pair of switches, indicated in FIG. 1 as switch 28, has its first and second fixed contacts respectively connected to terminal 16 and 18. The other switch 30 has its first fixed contact connected to terminal 20 and its second fixed contact connected to the second electrode 26. The chamber contains an electrorheologic fluid 32.

The switches 28 and 30 within the chamber 12 are respectively separated from the electrorheologic fluid 32 by means of the flexible diaphragms 28A and 30A. The materials selected for the flexible diaphragms 28A and 30A include those from the plastics family including polyethylene, polycarbonate and vinyl, as well as those from the rubber family including latex or silicone, in addition to those from the metal family including copper or aluminum.

FIG. 1 shows switches 28 and 30 as being normally open switches and arranged in parallel within the chamber 12. In general, the first switch 28 having it first fixed contact connected so the second terminal 16 is used to latch a desired input signal present on the second terminal 16. The second fixed contact of switch 28 is connected to third terminal 18 and provides the output signal from the latching switch 10 when switch 28 is rendered operative, as will be further described herein. The second switch 30 is connected in series with two parallel electrodes 24 and 26 at the entrance to the chamber 12, that is in correspondence with the opening 12A. This second switch 30 is used to apply a voltage across the electrodes. More particularly, the second switch 30 applies the positive potential of the voltage, connected to the fourth terminal 20, to the second electrode 26, whereas the negative potential of the applied voltage is present at the electrode 24 by way of the first terminal 14 that is connected to the ground. The voltage applied across the electrodes 24 and 26 serves as a latching voltage, as will be further described.

Figure 2:
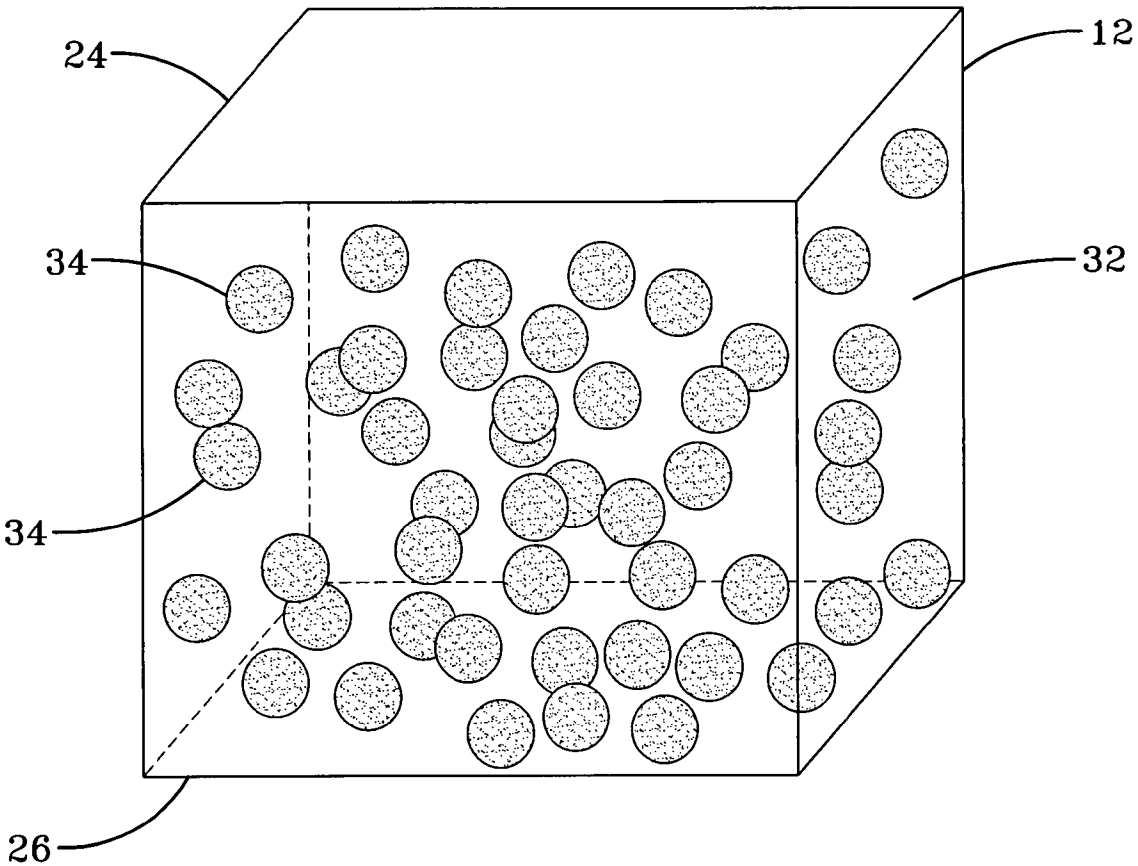
FIG. 2 is an illustration of the chamber of the latching switch of FIG. 1.

As shown in FIG. 2, the electrodes 24 and 26 are respectively located on the roof and floor of the chamber 12. As further seen in FIG. 2, the chamber 12 itself is filled with an electrorheologic fluid 32, known in the art and may be of the type more fully described in U.S. Pat. No. 6,186,176, herein incorporated by reference. Further, the electrorheologic fluid 32 is composed of nanoparticles 34, shown in FIG. 2.

As is known in the art, electrorheologic fluids 32 represent a class of smart materials, consisting of nanometers to micrometer sized solid particles 34 suspended in a liquid, whose rheological properties are controllable by an external electric field applied across the electrodes 24 and 26. The electric field may be further described with reference to FIG. 3.

Figure 3:
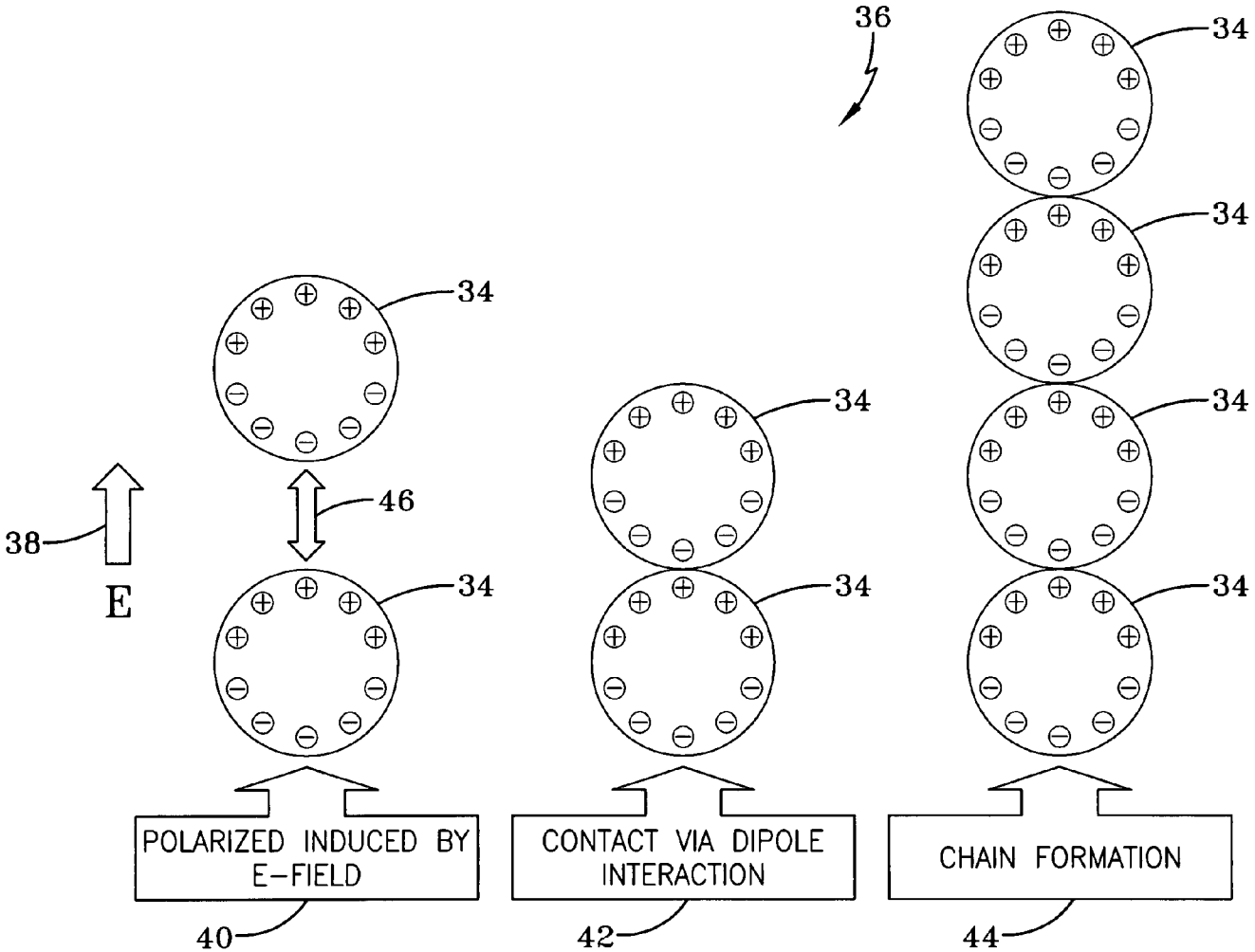
FIG. 3 illustrates the dipole interaction induced by an E-field associated with the operation of the present invention.

FIG. 3 illustrates a dipole interaction of the dispersed particles 34 in the electrorheologic fluid 32 induced by an E-field. More particularly, FIG. 3 illustrates an E-field 38 creating three phases 40, 42 and 44 of dipole interactions.

In general, the operation of the electrorheologic fluid 32 can be reversibly transformed from a liquid to a solid within a short period of time, such as one-hundredth of a second. While in a solid state (with the electric field 38 applied), the strength of that solid formed by the electrorheologic fluid 32 provides a relatively high yield stress which is a critical parameter of the electrorheologic fluid 32.

In the absence of an electric field, dispersed particles 34 in the electrorheologic fluid 32 shown in FIG. 2, move freely and are randomly distributing as shown by directional arrow 46. More particularly, with reference to FIG. 3, in the presence of a low electric field, such as, and as shown by phase 40, the dispersed particles 34 are polarized and aligned by electrostatic attraction forces from changes shown by directional arrow 46. As seen in phase 42, in presence of a medium electric field the particles 34 contact each other to form a chain. In the presence of a high electric field, as seen in phase 46, individual chains combined with nearby chains perform thick columns. The viscosity of the electrorheologic fluid 32 is thus increased with corresponding increases in electric field, resulting in directional solidification when the influence of the applied field is sufficient.

The electric field that is desired to be applied across the electrodes 24 and 26, that is, the latching voltage across electrodes 24 and 26, is in the order of 2 KV/mm as is known in the art. More particularly, it is desired that the latching voltage will provide a yield stress in the electrorheologic fluid in the order of 1–40 KPa. For such a yield stress factor, the electrode spacing needs to be in the order of about 0.1 mm to obtain these fields with a reasonable voltage. Under these desired conditions, the pressure activating the latching switch 10 is selected to respond to a pressure signal 22, shown in FIG. 1, in the range of a few pounds per square inch.

In Operation

The switch 10 of FIG. 1 is actuated by applying pressure, indicated by directional arrow 22, at the pressure inlet port 12A. This pressure causes both normally opened switches 28 and 30 to close. This closing action causes both the latching voltage at terminal 20 to appear across the electrodes 24 and 26 and the signal applied to input terminal 16 to appear at the output terminal 18.

The signal at terminal 18 is latched by the latching voltage that is now applied across the electrodes 24 and 26. This latching voltage serves to stiffen the electrorheologic fluid 32 to the point that the electrorheologic fluid 32 does not flow under applied pressure. This non-flow means that even if the inlet pressure, indicated by directional arrow 22, applied at the pressure input port 12A were to be removed, the pressure within the chamber 12 will not be relieved until the latching voltage is removed. This non-flow also means the signal at terminal 16 will continue to appear at the terminal 18 until the latching voltage is removed.

It should now be appreciated that the practice of the present invention provides for a switch and a method of operation thereof that provides for latching and that utilizes an electrorheologic fluid. The switch of the present invention is activated by a pressure signal and deactivated by the removal of both the pressure signal and a latching voltage. Further, the switch of the present invention maintains its selected mode until the removal of the latching voltage.

While the invention has been particularly shown and described with reference to preferred embodiments thereof, it will be understood by those skilled in the art that the foregoing and other changes in the form of details maybe made therein without departing from the spirit and scope of the invention.

I claim:

1. A latching switch comprising:

a chamber containing an electrorheologic fluid, said chamber having first, second, third and fourth terminals and having an opening capable of receiving a pressurized fluid;

at least a pair of spaced apart electrodes located within said chamber and with one of said electrodes connected to said first terminal; and at least a pair of switches each having first and second fixed contacts operatively interconnectable therebetween by a movable contact, each of said switches being located in said chamber and being responsive to said received pressurized fluid so as to be rendered operable, one of said pair of switches having first and second fixed contacts respectively connected to said second and third terminals, the other of said pair of switches having a first contact fixed connected to said fourth terminal and a second contact connected to the other electrode of said pair of spaced apart electrodes; and first and second diaphragms respectively and completely covering each of said pair switches, each of said first and second diaphragms being flexibly responsive to said pressurized fluid.

2. The latching switch according to claim 1, wherein said first, second, third and fourth terminals are respectively connectable to a ground potential, an input signal, an output signal, and a latching voltage.

3. The latching switch according to claim 1, wherein said diaphragm are of a flexible material selected from first, second, and third groups of materials with the first group consisting of polyethylene, polycarbonate and vinyl, the second group consisting of latex or silicone, and the third group consisting of copper or aluminum.

4. The latching switch according to claim 2, wherein the latching voltage is in the order of 2 KV/mm and spacing between the electrodes is in the order of 0.1 mm.

5. The latching relay according to claim 4, wherein each of said pair of switches as well as the respective covering flexible diaphragms thereof are selected to have parameters that cause the moveable contact of each pair of switches to interconnect the respective first and second fixed contacts in response to the pressurized fluid in the order of a two (2) psi.

6. The latching switch according to claim 4, wherein parameters of said chamber and said electrorheologic fluid are chosen to cause a yield stress within said electrorheologic fluid in response to the application of said latching voltage in the order of 2 KVmm.

7. A method of latching a switch comprising the steps of:

a) providing a chamber containing an electrorheologic fluid, having first, second, third and fourth terminals and having an opening capable of receiving a pressurized fluid;

b) providing at least a pair of spaced apart electrodes being located with said chamber;

c) connecting one of said electrodes to said first terminal;

d) providing at least a pair of switches each having first and second fixed contacts operatively interconnectable therebetween by a movable contact, each of said switches being located with said chamber and being responsive to said received pressurized fluid so as to be rendered operative;

e) connecting said first and second fixed contacts of one of said pair of switches to said second and third terminals respectively;

f) connecting the other of said pair of switches so that a first contact is connected to said fourth terminal and a second fixed contact is connected to the other electrode of said pair of spaced apart electrodes;

g) providing first and second diaphragms respectively and completely covering each of said pair switches, each of said first and second diaphragms being flexibly responsive to said pressurized fluid;

h) connecting said first, second, third and fourth terminals respectively connectable to a ground potential, an input signal, an output signal and a latching voltage; and i) applying said pressurized fluid.

8. The method of latching a switch according to claim 7, wherein said diaphragm are of a flexible material selected from first, second, and third groups of materials with the first group consisting of polyethylene, polycarbonate and vinyl, the second group consisting of latex or silicone, and the third group consisting of copper or aluminum.

9. The method of latching a switch according to claim 8, wherein said latching voltage is in the order of 2 KV/mm and said spacing between electrodes is in the order of 0.1 mm.

10. The method of latching a switch according to claim 9, wherein each of said pair of switches as well as the respective covering flexible diaphragms thereof are selected to have parameters that cause the moveable contact of each pair of switches to interconnect the respective first and second fixed contacts in response to the pressurized fluid in the order of a two (2) psi.

11. The latching switch according to claim 9, wherein parameters of said chamber and said electrorheologic fluid are chosen to cause a yield stress within said electrorheologic fluid on the order of 1–40 KPa in response to the application of said latching voltage in the order of 2 KVmm.

* * * * *